US005999064A

United States Patent [19]

Blacka et al.

[11] Patent Number: 5,999,064

[45] Date of Patent: Dec. 7, 1999

[54] HEATED TEMPERATURE VARIABLE ATTENUATOR

[75] Inventors: Robert Blacka, Pennsauken, N.J.; David Markman, Dresher, Pa.; Joseph B. Mazzochette, Cherry Hill, N.J.

[73] Assignee: EMC Technology LLC, Cherry Hill, N.J.

[21] Appl. No.: 09/120,751

[22] Filed: Jul. 23, 1998

[51] Int. Cl.[6] ..... H01P 1/22

[52] U.S. Cl. ..... 333/81 R; 333/81 A

[58] Field of Search ..... 333/81 R, 81 A

[56] References Cited

U.S. PATENT DOCUMENTS

| | | | |
|---|---|---|---|
| 4,097,827 | 6/1978 | Williams | 333/81 R |
| 4,201,959 | 5/1980 | Niiro et al. | 333/16 |
| 4,340,780 | 7/1982 | Odlen | 333/28 R |
| 4,965,538 | 10/1990 | Mickey, III | 333/81 A |
| 4,970,478 | 11/1990 | Townley | 333/81 R |
| 5,332,981 | 7/1994 | Mazzachette et al. | 333/81 R |
| 5,440,280 | 8/1995 | Lord | 333/81 R |
| 5,453,721 | 9/1995 | Geiger et al. | 333/81 R |

FOREIGN PATENT DOCUMENTS 2-34013 2/1990 Japan .

*Primary Examiner*—Benny Lee
*Assistant Examiner*—Barbara Summons
*Attorney, Agent, or Firm*—Donald S. Cohen

[57] ABSTRACT

A temperature compensating voltage variable attenuator includes at least two temperature variable resistors. The temperature variable resistors have different temperature coefficients of resistance, preferably, with one temperature variable resistor having a positive temperature coefficient of resistance and the other temperature variable resistor having a negative temperature coefficient of resistance. The temperature coefficient of resistance of the temperature variable resistors being such that the attenuation of the attenuator varies with changes in temperature of the attenuator. A voltage variable heater resistor is adjacent both temperature variable resistors so that a change in the voltage applied to the heater resistor changes the temperature of the heater resistor. The heat from the heater resistor is applied to the temperature variable resistors so as to change the resistance of the temperature variable resistors. This provides a controlled change in the attenuation of the attenuator.

13 Claims, 4 Drawing Sheets

HEATED TEMPERATURE VARIABLE ATTENUATOR

FIELD OF THE INVENTION

The present invention relates to a heated temperature variable attenuator, and, more particularly, to a temperature variable attenuator including resistance heating means for heating the temperature variable resistors forming the attenuator.

BACKGROUND OF THE INVENTION

Attenuators are used in applications that require signal level control. For microwave applications, absorptive attenuators, i.e., attenuators which absorb some of the signal in the attenuator itself, are preferred over reflective attenuators which reflect a portion of the input signal back to its source. The important parameters of an absorptive attenuator are its accuracy as a function of frequency, its return loss and its stability over time and temperature. It is known that variations in temperature can affect various component parts of a microwave system causing differences in signal strengths at different temperatures. Much time, effort and expense has gone into the components of such systems in an effort to stabilize them over various temperature ranges. This greatly increased the cost of microwave systems that must be exposed to wide temperature ranges.

A system which has been developed to simply and easily overcome temperature variation problems in a microwave attenuator is the temperature variable attenuator shown and described in U.S. Pat. No. 5,332,981 to Joseph B. Mazzochette et al., issued Jul. 26, 1994, entitled "Temperature Variable Attenuator", which is incorporated herein by reference. This device comprises at least two temperature variable resistors. One of the resistors has a temperature coefficient of resistance which is different from that of the other resistor. Preferably, one of the resistors has a positive temperature coefficient of resistance and the other resistor has a negative temperature coefficient of resistance. The temperature coefficient of resistance of the two resistors are such that the attenuation of the attenuator changes at a controlled rate with changes in ambient temperature, but wherein the impedance of the attenuator remains constant at the attenuation changes. Although this device operates satisfactorily, it is often desirable to extend the use of the device by making it a voltage variable attenuator and to provide better compensation at high temperatures.

ABSTRACT OF THE INVENTION

A microwave attenuator including at least first and second resistors with the first resistor having a temperature coefficient of resistance different from the temperature coefficient of resistance of the second resistor. The temperature coefficient of resistance of the two resistors being such that the attenuation of the attenuator changes at a controlled rate with changes in the temperature of the attenuator but wherein the impedance of the attenuator remains substantially constant as the attenuation changes. A voltage variable heating means is provided for simultaneously heating the first and second resistors so that the attenuator is a temperature compensating, voltage variable attenuator.

DETAILED DESCRIPTION

Figure 1:
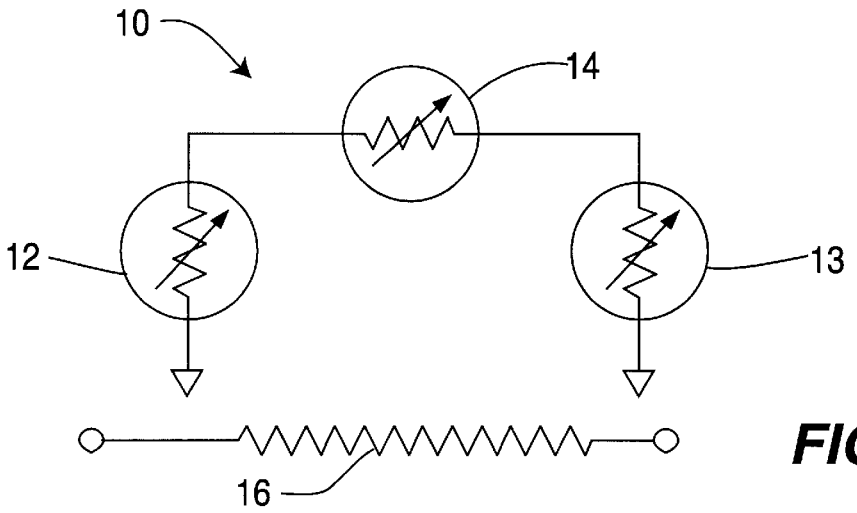
FIG. 1 is a circuit diagram showing the basic structure of an attenuator in accordance with the present invention.

Referring initially to FIG. 1 there is shown a circuit diagram of the basic attenuator 10 of the present invention. Attenuator 10 comprises three temperature variable resistors 12, 13 and 14, such as thermistors. The temperature variable resistors 12 and 13 are connected in parallel with each other and in series with the temperature variable resistor 14. The two temperature variable resistors 12 and 13 have the same temperature coefficients of resistance, which are different from the temperature coefficient of resistance of the temperature variable resistor 14. Preferably, the temperature variable resistors have a temperature coefficient of resistance of one polarity, such as a positive temperature coefficient of resistance, and the other temperature sensitive resistor 14 has a temperature coefficient of resistance of the opposite polarity, such as a negative temperature coefficient of resistance. Also, it is preferred that the two temperature sensitive resistors 12 and 13 have substantially the same resistance value and substantially the same value of the temperature coefficient of resistance. Also, the temperature variable resistor 14 has a temperature coefficient of resistance of the same value as that of the temperature variable resistors 12 and 13, but of the opposite polarity Thus, if the temperature of the three temperature sensitive resistors 12, 13 and 14 increases, the resistance of the temperature sensitive resistors 12 and 13 will increase and the resistance of the temperature sensitive resistor 14 will decrease. A voltage variable heater resistor 16 extends across all of the temperature sensitive resistors 12, 13 and 14. When a voltage is placed across the heater resistor 16 it will heat up and the heat will be directed toward to temperature variable resistors 12 and 14. By varying the voltage applied to the heater resistor 16, the heat from the heater resistor will vary causing a variation in the heating of the temperature variable resistors 12, 13 and 14. This, in turn, will vary the resistance value of the temperature sensitive resistors 12, 13 and 14. However, since the resistance value of the temperature sensitive resistors 12 and 13 will increase and the resistance of the temperature sensitive resistor 14 will decrease a like amount, the variation in resistance of the attenuator 10 will remain constant. As described in U.S. Pat. No. 5,332,981 this provides an attenuator in which the attenuation is varied but in which the impedance remains constant. Thus, the attenuator 10 is a temperature compensating, voltage variable attenuator. Although the attenuator 10 has been described as being formed of three temperature sensitive resistors, as shown and described in U.S. Pat. No. 5,332,981, it can be formed of only two temperature sensitive resistors, one having a positive temperature coefficient of resistance and the other having a negative temperature coefficient of resistance. Although the attenuation of such an attenuator will vary with changes in temperature, the impedance of the attenuator will not remain constant.

Figure 2:
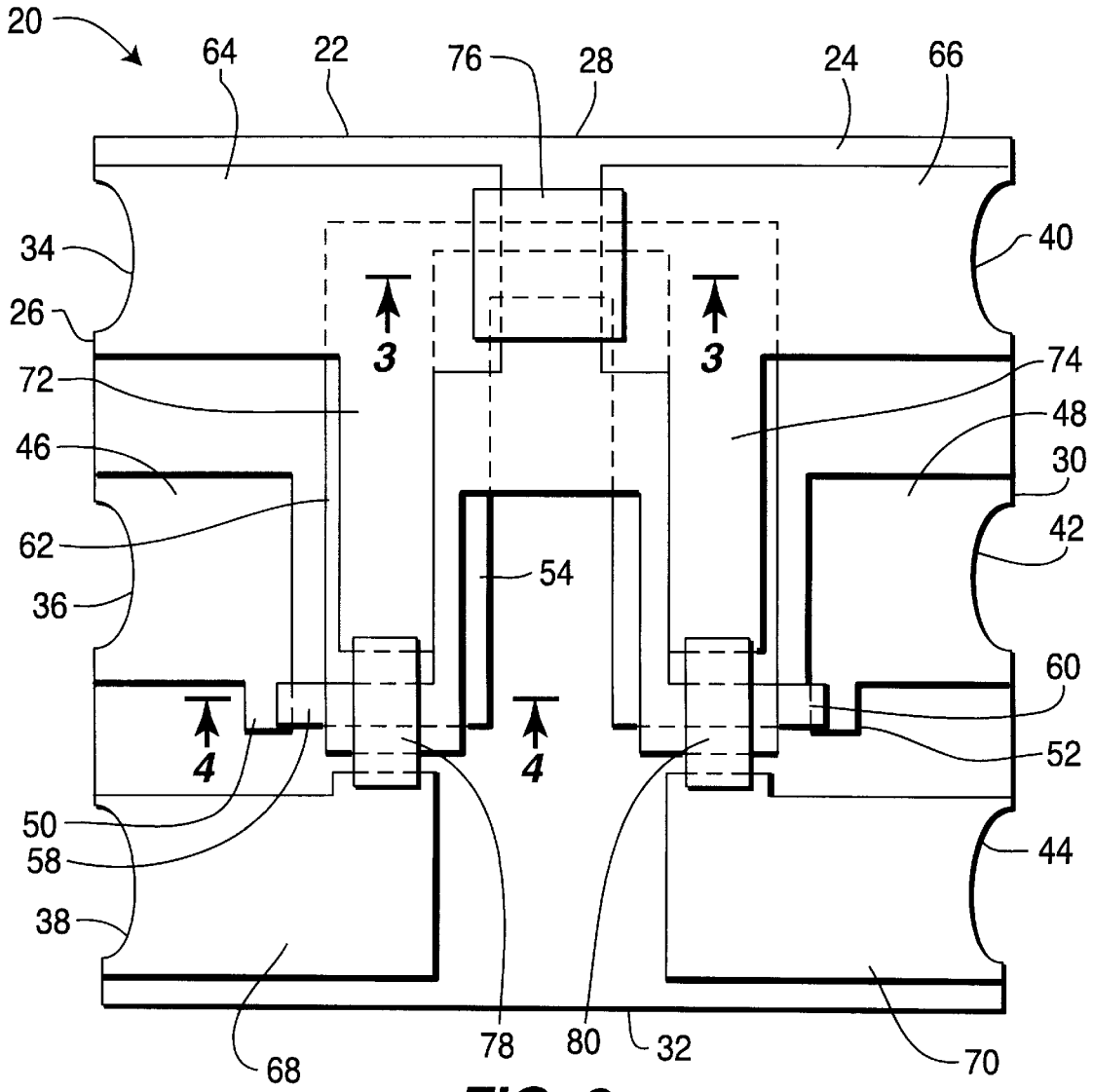
FIG. 2 is a top view of one form of the attenuator of the present invention.
Figure 3:
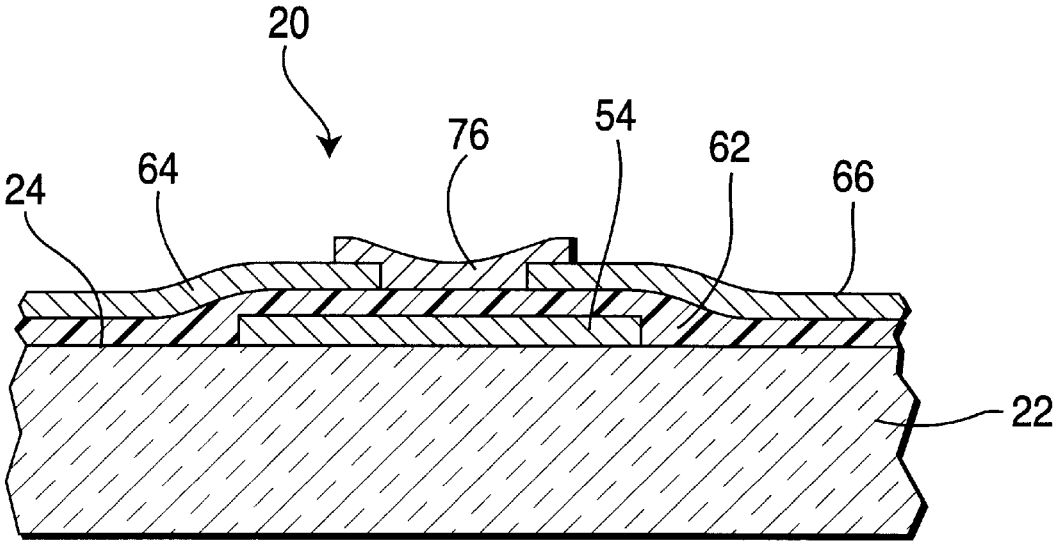
FIG. 3 is a sectional view taken along line 3—3 of FIG. 2.
Figure 4:
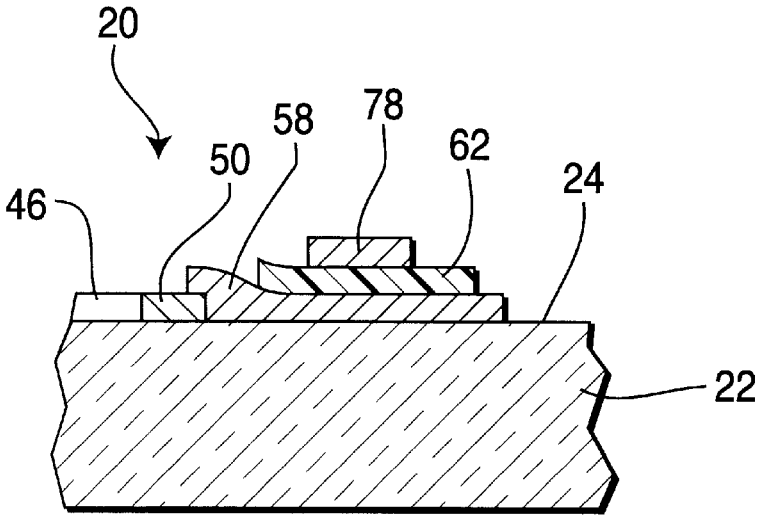
FIG. 4 is a sectional view taken along line 4—4 of FIG. 2.

Referring now to FIG. 2, there is shown a top view of a form of the heated temperature variable attenuator of the present invention, which is generally designated as 20. Attenuator 20 comprises a substantially flat substrate 22 of an insulating material, such as a glass, ceramic or high temperature plastic. The substrate 22 has a flat surface 24 and is substantially rectangular having four side edges 26, 28, 30 and 32. One of the side edges 26 has three spaced notches 34, 36 and 38 therein, and the side edge 30, which is opposite the side edge 26, also has three spaced notches 40, 42 and 44 therein. Each of the notches 40, 42 and 44 in the side edge 30 is directly opposite a separate one of the notches 34, 36 and 38 in the side edge 26.

Figure 5:
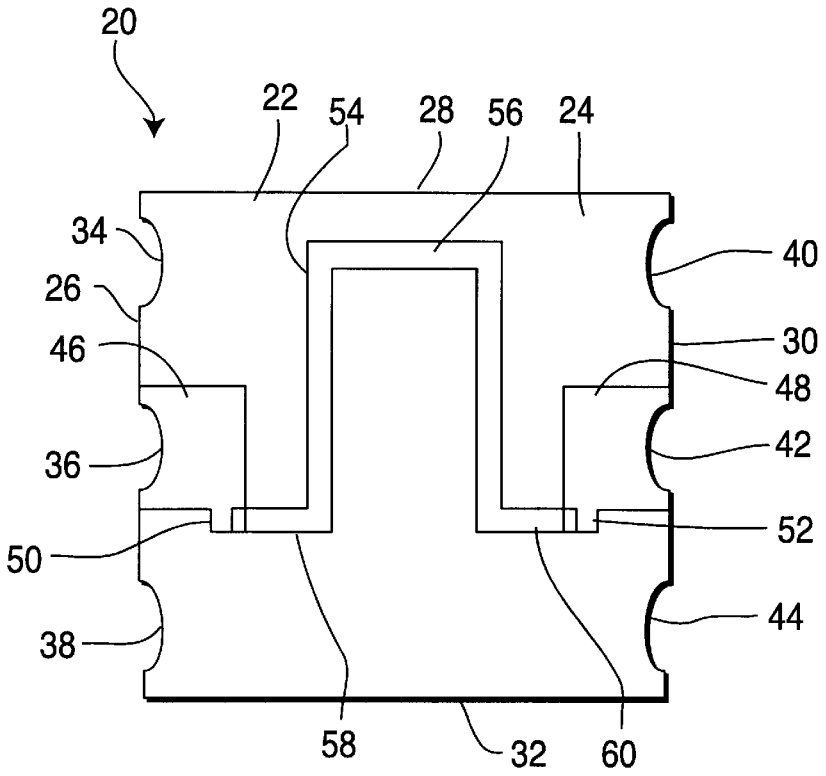
FIG. 5 is a top view of the attenuator of FIG. 1 showing along the heater resistor and its contacts.
Figure 6:
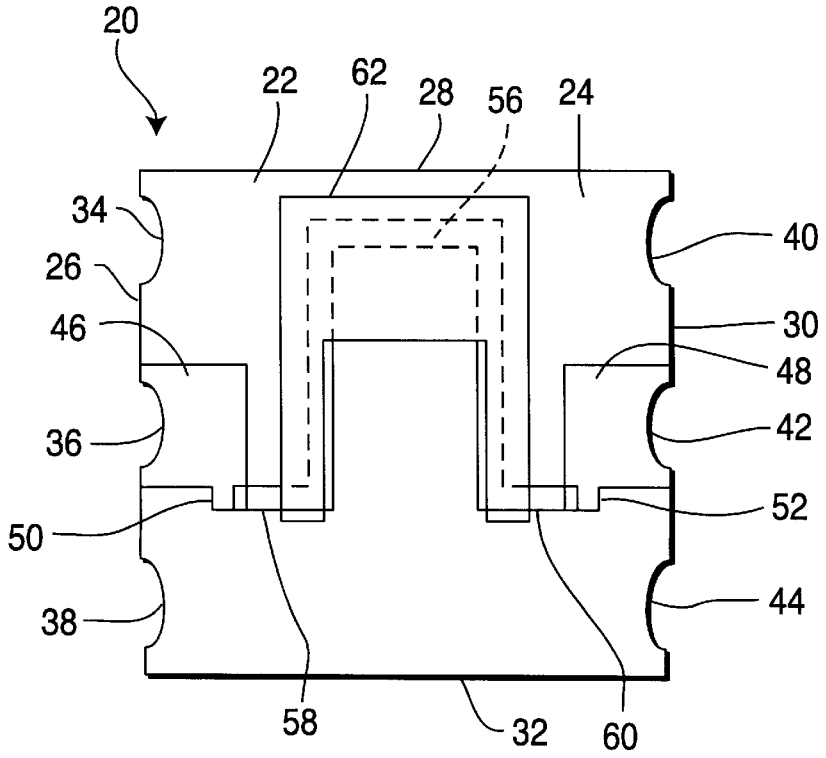
FIG. 6 is a top view of the portion of the attenuator shown in FIG. 4 with a dielectric layer over the heater resistor.

As shown in FIG. 5, on the surface 24 of the substrate 22 are two contact areas 46 and 48, each of a layer of a conductive material, such as a metal. The contact area 46 extends from the notch 36 in the side edge 26, and the contact area 48 extends from the notch 42 in the side edge 30. Each of the contact areas 46 and 48 has a leg 50 and 52 extending therefrom toward the side edge 32. On the surface 24 of the substrate 22 between the contact areas 46 and 48 is a heater resistor 54 in the form of a layer of a resistance material. The heater resistor 54 has a U-shaped portion 56 between the contact areas 46 and 48 with a separate arm 58 and 60 at each end thereof extending toward and making contact with a separate one of the legs 50 and 52 of the contact areas 46 and 48. Thus, the heater resistor 54 is electrically connected between the contact areas 46 and 48. As shown in FIG. 6, a layer 62 of a dielectric material is on the surface 24 of the substrate 22 and extends over the heater resistor 54. The dielectric layer 62 is substantially U-shape so as to extend over and cover the U-shape portion 56 of the heater resistor 54. The dielectric layer 62 may be of any suitable dielectric material, such as a glass, ceramic or plastic.

As shown in FIG. 2, on the surface 24 of the substrate 22 are four contact areas 64, 66, 68 and 70 of a layer of a conductive material, such as a metal. Each of the contact areas 64 and 66 extends from a separate notch 34 and 40 respectively toward each other but are spaced apart. Each of the contact areas 68 and 70 extend from a separate notch 38 and 44 respectively toward each other but are spaced apart. The contact areas 64 and 66 extend over the dielectric layer 62 so as to be insulated from the heater resistor 54. Each of the contact areas 64 and 66 has a leg 72 and 74 extending therefrom toward a separate contact area 68 and 70, but is spaced from the respective adjacent contact area 68 and 70

A first temperature variable resistor 76 extends between and is electrically connected to the contact areas 64 and 66. The first temperature variable resistor 76 is of a film of a suitable resistance material which is coated over the surface 24 of the substrate 22 and the dielectric layer 62. A second temperature variable resistor 78 extends between and contacts the leg 72 of the contact area 64 and the contact area 68, and a third temperature variable resistor 80 extends between and contacts the leg 74 of the contact area 66 and the contact area 70. The second and third temperature variable resistors 78 and 80 are films of a suitable resistance material which are coated over the dielectric layer 62 Each of the first, second and third temperature variable resistors 76, 78 and 80 extend across and overlap a portion of the heater resistor 54, but is insulated from the heater resistor 54 by the dielectric layer 62. As described in U.S. Pat. No. 5,332,981, the first temperature variable resistor 76 has a temperature coefficient of resistance which is different from the temperature coefficient of resistance of each of the second and third temperature variable resistors 78 and 80. Preferably, the first temperature variable resistor 76 has a temperature coefficient of resistance of one polarity, such as a negative temperature coefficient of resistance, whereas each of the second and third temperature variable resistors 78 and 80 have a temperature coefficient of resistance of the opposite polarity, such as a positive temperature coefficient of resistance. Thus, the second and third temperature variable resistors 78 and 80 are electrically connected in parallel with respect to each other and are electrically connected in series with the first temperature variable resistor 76. However, all of the temperature variable resistors 76, 78 and 80 overlap a portion of the heater resistor 54 so that a variation in the temperature of the heater resistor 54 will cause a variation in the temperature of each of the temperature variable resistors 76, 78 and 80.

In the attenuator 20, the dielectric layer 62 does not completely cover the heater resistor 54, but leaves portions of the heater resistor 54 adjacent the contact layers 46 and 48 exposed to allow for laser trimming of the heater resistor 54. Also, the temperature variable resistors 76, 78 and 80 are positioned offset over the heater resistor 54 to prevent the possibility of cutting the heater resistor 54 during the laser trimming of the temperature variable resistors 76, 78 and 80.

The temperature variable resistors 76, 78 and 80 are electrically connected to form an attenuator, which, as described in U.S. Pat. No. 5,332,981, is a temperature variable attenuator. Since one of the temperature variable resistors has a temperature coefficient of resistance of one polarity, and the other two temperature variable resistors have temperature coefficients of resistance of the opposite polarity, the attenuator operates to provide a variation in attenuation with variations in the temperature of the device while maintaining a substantially constant impedance. However, in the attenuator 20 of the present invention, a voltage applied across the heater resistor 54 will result in an increase in the temperature of the heater resistor 54. The heat from the heater resistor 54 will then flow to the temperature variable resistors 76, 78 and 80. This will result in a change in the resistance of the temperature variable resistors 76, 78 and 80. Thus, the attenuation of the attenuator 20 of the present invention is affected by three variables, i.e., the ambient temperature, the DC power dissipated in the heater resistor, and the RF power dissipated in the attenuator.

Figure 7:
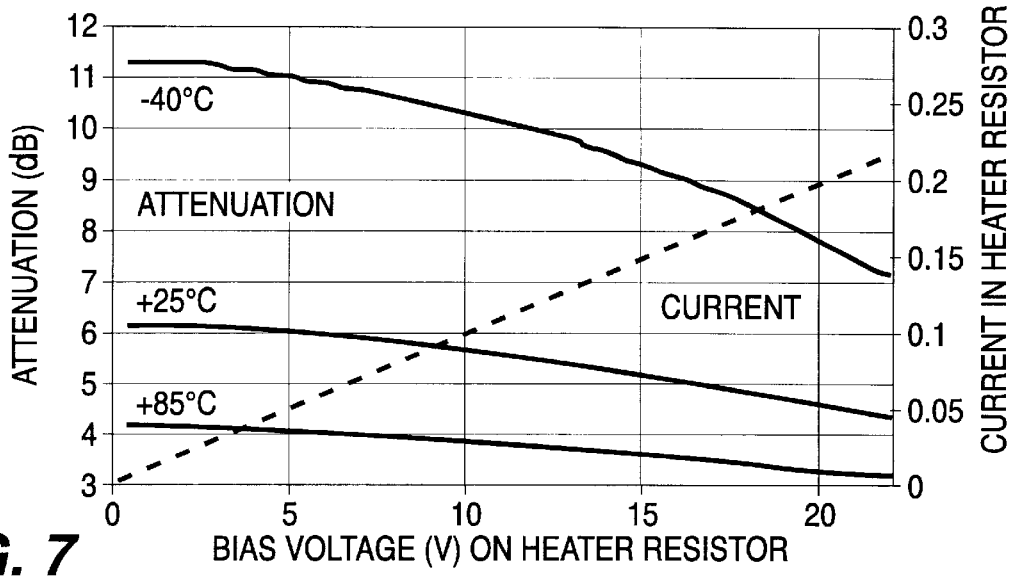
FIG. 7 is a graph showing the attenuation vs. temperature for changing heater bias current and for several different ambient temperatures.
Figure 8:
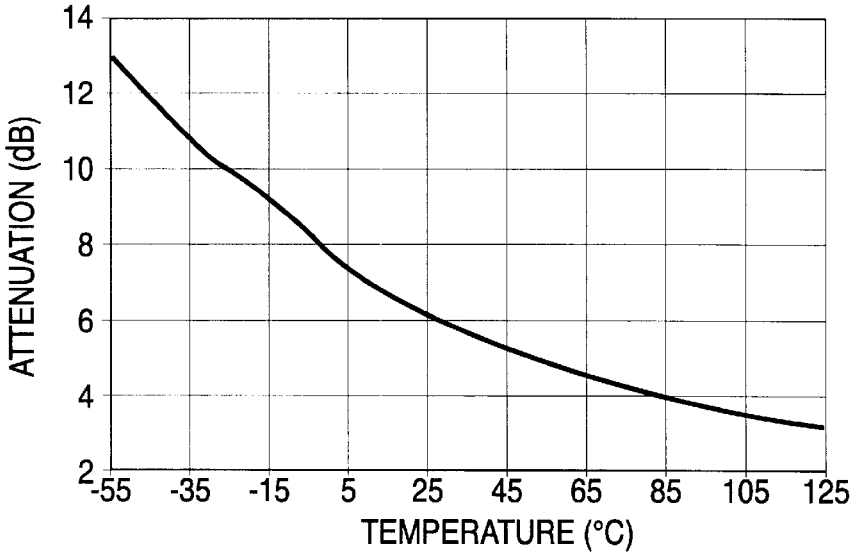
FIG. 8 is a graph showing the attenuation vs. temperature for an unheated attenuator.

FIG. 7 is a graph showing the attenuation vs. temperature for changing heater bias and for several different ambient temperatures. The increased rate of change in attenuation with bias current at very low temperatures is due to the nonlinear characteristics of the non-heated attenuator, which are shown in FIG. 8. In FIG. 7, the dash line indicates the change in current in the heater resistor with changes in the voltage. The effect of heating due to dissipation of RF power may be accounted for by calculating the part temperature rise using a thermal resistance factor of 0.2 W/°C. for a device which is 0.122" by 0.165" and a thickness of 0.020 inches. The heated attenuator of the present invention will react to changes in ambient temperature, as does the attenuator shown in U.S. Pat. No. 5,332,981. In addition to ambient temperature compensation, the heated attenuator of the present invention may be biased to change the temperature of the temperature variable resistors and control the attenuation.

Figure 9:
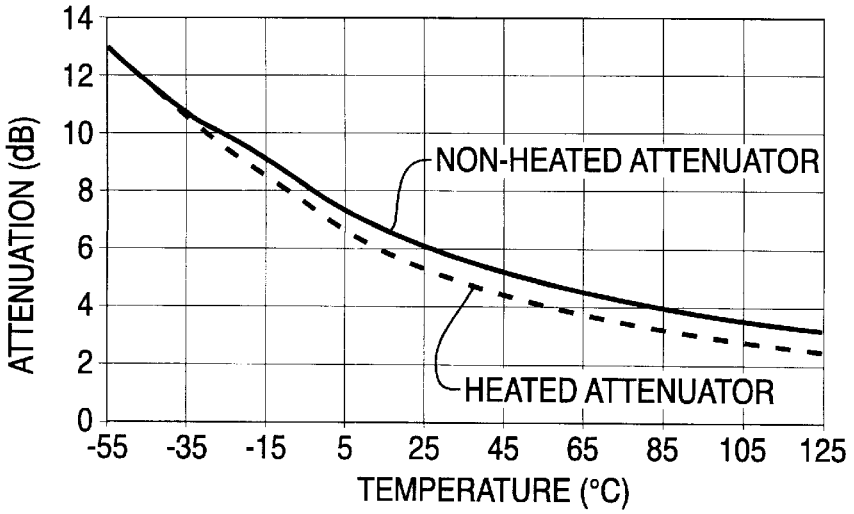
FIG. 9 is a graph showing the attenuation vs. temperature for a heated attenuator.

The heated attenuator of the present invention may be biased to improve temperature compensation at high temperatures. As shown in FIG. 8, the compensation of the attenuator decreases with increasing temperature. By increasing the bias on the heated attenuator of the present invention, the compensation may be increased at high temperatures. The linearity of the attenuator vs. temperature can be improved using the heated attenuator of the present invention. FIG. 9 is a graph showing the improvements in attenuator compensation when biased so as to heat the temperature variable resistors. The solid line shows the change in attenuation with changes in ambient temperature for a non-heated attenuator, and the dash line shows the change in attenuation with changes in ambient temperature for a heated attenuator of the present invention.

Thus there is provided a temperature compensating attenuator in which changes in the ambient temperature cause a change in the attenuation, but wherein the impedance remains substantially constant, and which includes voltage variable heating means for selectively heating the temperature variable resistors of the attenuator. This provides a temperature compensating, voltage variable attenuator. The heating means provides for improved temperature compensation at high temperatures, and the linearity of the attenuator vs. temperature can be improved.

What is claimed is:

1. A microwave attenuator comprising:

at least first and second resistors, said first resistor having a temperature coefficient of resistance which is different from the temperature coefficient of resistance of the second resistor, the temperature coefficient of resistance of said resistors being such that the attenuation of said attenuator changes at a controlled rate with changes in temperature of the attenuaton; and a voltage variable heating means for substantially simultaneously heating the first and second resistors.

2. The attenuator of claim 1 wherein one of the first and second resistors has a positive temperature coefficient of resistance and the other resistor has a negative temperature coefficient of resistance.

3. The attenuator of claim 2 wherein the voltage variable heating means comprises a heater resistor.

4. The attenuator of claim 3 further comprising a third resistor connecting in parallel with one of the first and second resistors with the two parallel resistors being connected in series with the other resistor, the third resistor having the same temperature coefficient of resistance as the resistor in which it is in parallel, said attenuator having an impedance which remains constant as the attenuation changes.

5. A microwave attenuator comprising:

a substrate of an insulating material having a substantially flat surface;

spaced first and second contact layers of a conductive material on said surface of the substrate;

a layer of a heater resistor material on said substrate surface and extending between and contacting the first and second contact layers;

a first temperature variable resistor layer on said substrate surface and extending across at least a portion of the heater resistor layer;

a second temperature variable resistor layer on said substrate surface and extending across at least a portion of the heater resistor layer, said second temperature variable resistor having a temperature coefficient of resistance which is different from the temperature coefficient of resistance of the first temperature variable resistor;

means electrically connecting the first and second temperature variable resistors; and insulating means between the heater resistor layer and each of the first and second temperature variable resistors.

6. The attenuator of claim 5 in which the insulating means comprises a layer of an insulating material over at least a portion of the heater resistor layer with the first and second temperature variable resistors being over the insulating layer.

7. The attenuator of claim 6 further comprising a third temperature variable resistor layer on said insulating layer and extending across a portion of the heater resistor, said third temperature variable resistor having a temperature coefficient of resistance substantially the same as that of the second temperature variable resistor, and means electrically connecting the third temperature variable resistor in parallel with the second temperature variable resistor and in series with the first temperature variable resistor.

8. The attenuator of claim 7 further comprising third, fourth, fifth and sixth contact layers of a conducive material on the substrate surface, the first temperature variable resistor being electrically connected between the third and fourth contact layers, the second temperature variable resistor being electrically connected between the third and fifth contact layers, and the third temperature variable resistor being electrically connected between the fourth and sixth contact layers.

9. The attenuator of claim 8 in which the substrate is substantially rectangular, the third and fifth contact layers extend from a first edge of the substrate and are spaced apart, and the fourth and sixth contact layers extend from a second edge opposite the first edge and are spaced apart.

10. The attenuator of claim 9 in which the first contact layer extends from the first edge of the substrate and is between the third and fifth contact layers, and the second contact layer extends from the second edge of the substrate and is between the fourth and sixth contact layers.

11. The attenuator of claim 10 in which the heater resistor is substantially U-shaped and has feet extending from the ends thereof with the legs contacting the first and second contact layers respectively.

12. The attenuator of claim 11 in which the first temperature variable resistor layer extends across one portion of the heater resistor and each of the second and third temperature variable resistors extend across different portions of the heater resistor.

13. The attenuator of claim 7 in which the first temperature variable resistor has a temperature coefficient of resistance of one polarity and the second and third temperature variable resistors each have a temperature coefficient of resistance of the opposite polarity.

* * * * *